US007096511B2

(12) United States Patent
Cohen

(10) Patent No.: US 7,096,511 B2
(45) Date of Patent: Aug. 29, 2006

(54) ARTICLE OF CLOTHING

(76) Inventor: Michael P. Cohen, P.O. Box 635, Dillwyn, VA (US) 23938

( * ) Notice: Subject to any disclaimer, the term of this patent is extended or adjusted under 35 U.S.C. 154(b) by 156 days.

(21) Appl. No.: 10/480,877

(22) PCT Filed: Apr. 9, 2003

(86) PCT No.: PCT/US03/10764

§ 371 (c)(1),
(2), (4) Date: Dec. 12, 2003

(87) PCT Pub. No.: WO03/086121

PCT Pub. Date: Oct. 23, 2003

(65) Prior Publication Data

US 2004/0210984 A1 Oct. 28, 2004

Related U.S. Application Data

(60) Provisional application No. 60/371,239, filed on Apr. 9, 2002.

(51) Int. Cl.
*A42B 1/18* (2006.01)

(52) U.S. Cl. ..... 2/206; 2/DIG. 11

(58) Field of Classification Search ..... 2/9, 2/425, 206, 208, 209, 174, 171, DIG. 11, 2/209.11, 171.1, 172, 173, 207
See application file for complete search history.

(56) References Cited

U.S. PATENT DOCUMENTS

| | | | | | |
|---|---|---|---|---|---|
| 1,431,287 | A | * | 10/1922 | Cohn | 2/172 |
| D92,603 | S | * | 6/1934 | James | D2/823 |
| 2,039,478 | A | * | 5/1936 | Ensten | 2/203 |
| 2,199,473 | A | * | 5/1940 | Wengen | 2/172 |
| 2,820,227 | A | * | 1/1958 | Wiener | 2/204 |
| 3,287,737 | A | * | 11/1966 | Schuessler | 2/173 |
| 3,307,202 | A | * | 3/1967 | Schuessler | 2/173 |
| 3,340,542 | A | * | 9/1967 | Greenwald | 2/209.11 |
| 5,768,713 | A | * | 6/1998 | Crick | 2/409 |

* cited by examiner

*Primary Examiner*—Katherine M Moran
(74) *Attorney, Agent, or Firm*—Jagtiani & Guttag

(57) ABSTRACT

A clothing garment is formed in two loops or bands as unitary garment. A first of the two loops is an elongated member and the second is an elongated, non-rectangular member, having a wide central region. The two loops can be in the form of two pieces of fabric sewn or otherwise bonded together to form two joined loops. The loops can be elongated pieces of fabric formed into loops by a releasable closure member, such as a hook and loop connector. The connector can provide size adjustment to accommodate various head sizes. The loop with the wide central region is shorter than the essentially rectangular loop.

14 Claims, 7 Drawing Sheets

Figure 10
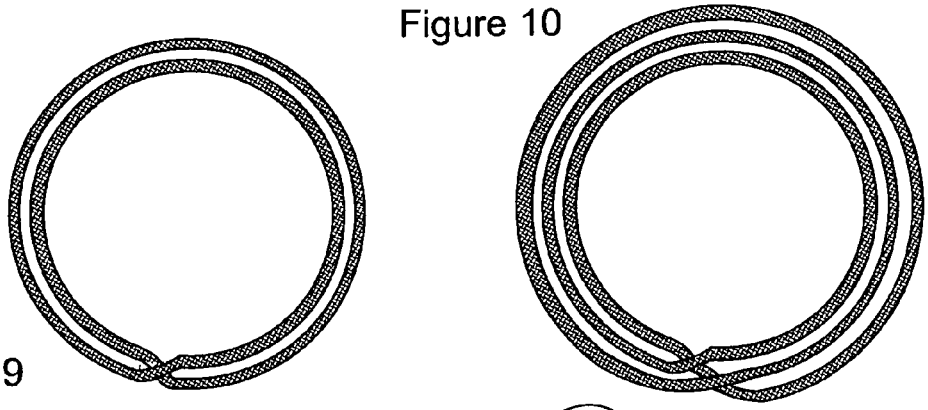
Figure 9
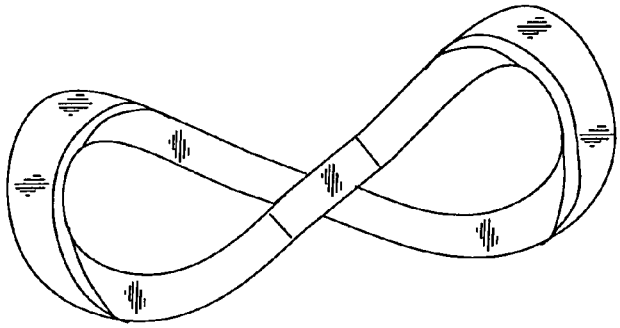
Figure 13
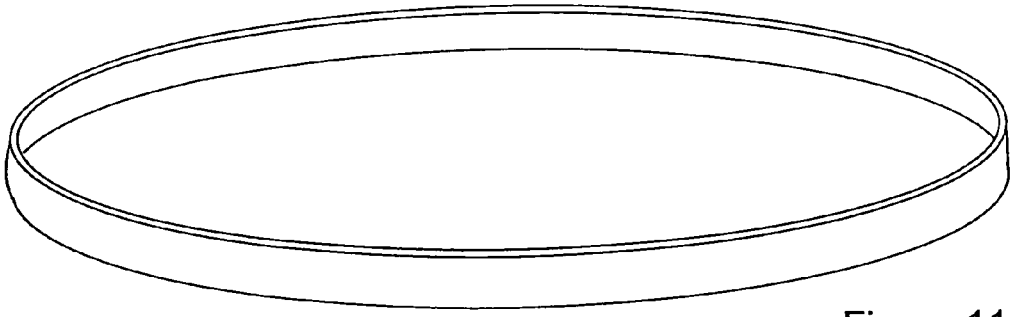
Figure 11
Figure 12
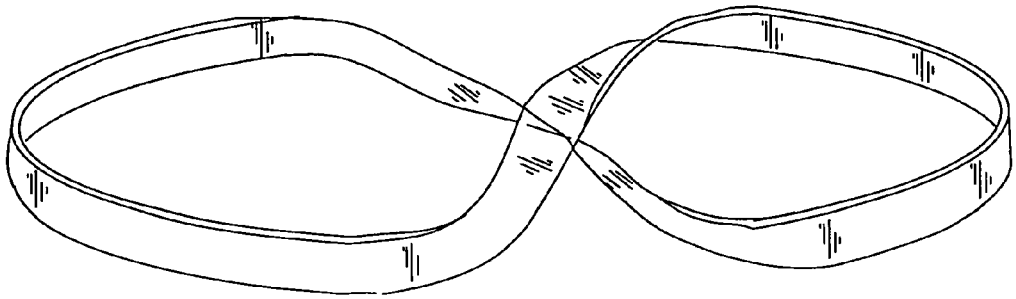

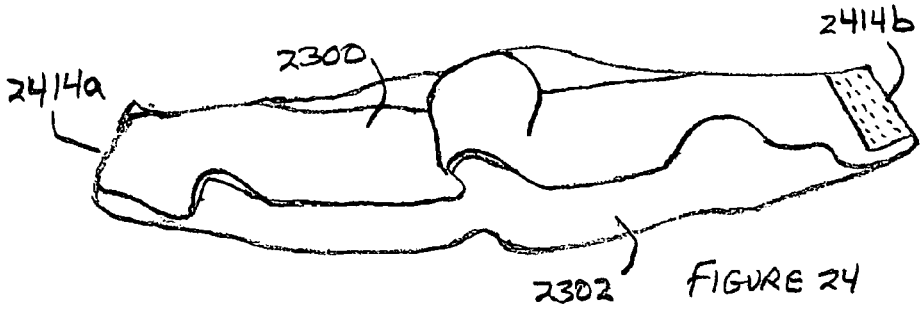
FIGURE 24
FIGURE 22
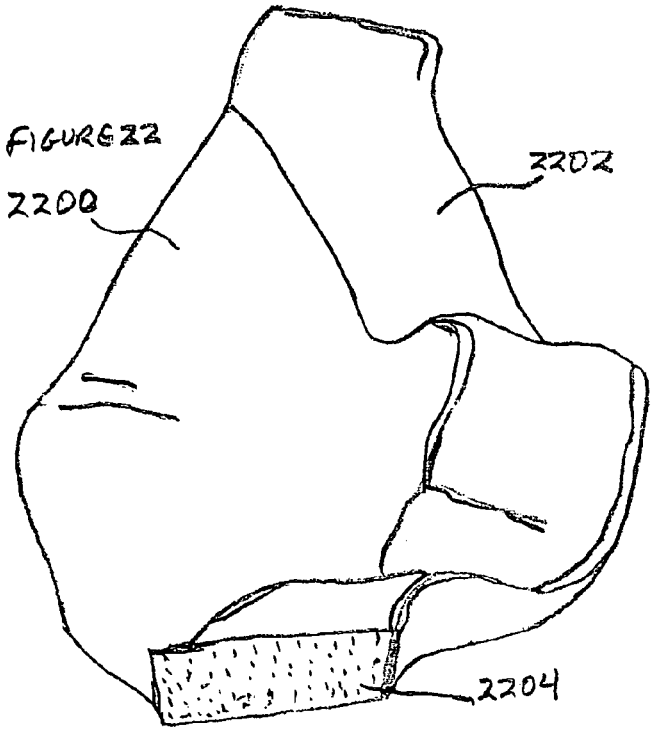
FIGURE 23
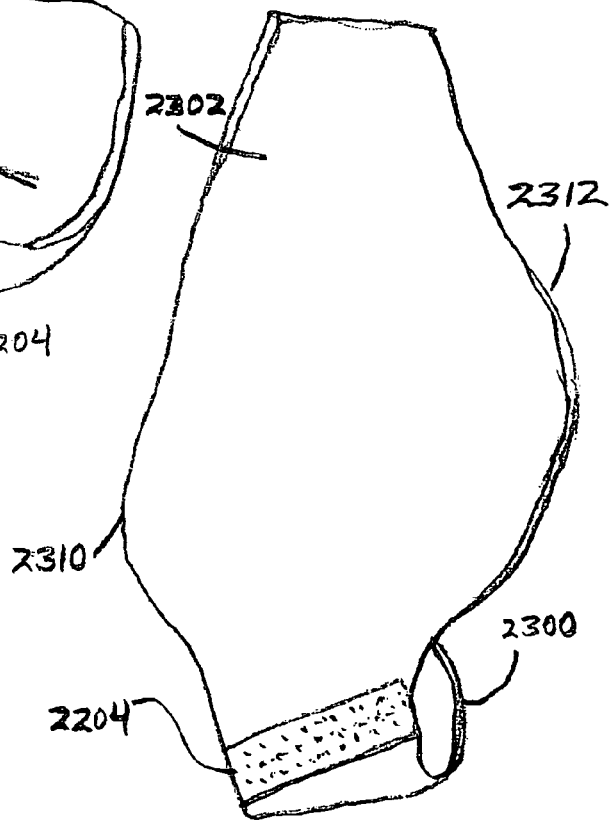

ARTICLE OF CLOTHING

This application claims the benefit of Provisional Application No. 60/371,239, filed Apr. 9, 2002.

FIELD OF INVENTION

The present invention relates to a multi-function garment that is worn on the head and/or neck, and more particularly to a garment that has the features of a head band, ear muff, muffler, scarf, and ski mask, in any combination or individually.

BACKGROUND OF THE INVENTION

Exposure to cold weather may subject a person to the discomfort and possible danger of heat loss, especially in the head and neck areas. Traditionally, many have utilized hats and scarves to minimize loss of body heat.

While this combination of garments is effective, drawbacks persist with their use. Scarves may come unraveled with activity and often prove difficult to readjust for proper facial coverage. Hats often leave the user's hair in a flattened state while unable to cover substantial portions of the face. Both garments lack the flexibility of multiple wearing positions by the user.

Neck garments such as U.S. Pat. No. 5,007,115 "Adjustable head and neck garment" solve the problem of unraveling, but only covers the neck and lower facial regions. Protective headbands composed of thermal insulating material such as U.S. Pat. No. 5,038,412 "Headband With Earmuffs" reduce flattened hair, but only allow for protection of the ears and forehead.

SUMMARY OF THE INVENTION

It has now been found that an integrated headband and a neck garment can provide overall improved head and neck coverage, while providing the flexibility of wearing the garment in any one of a plurality of different positions. The garment a simple protective garment that can be used as a headband, earmuff, muffler, scarf, ski mask, or any combination of these garments and is capable of optimally protecting the neck and head from heat loss.

It has now been found that an improved garment can be provided from a single garment formed of a single length of pliable fabric or two fabric units that are combined to form an integrated garment. The term "pliable" as employed herein refers to a fabric that can be stretched in at least the long direction, but optionally, can also stretch in width. The stretching enhances the ability of the fabric to conform to the shape of the user's facial contours, in particular, the nose and chin.

The design, in one embodiment, utilizes at least two loops of fabric, which can be sewn together or removably fastened at one section of the loops. The garment's unique shape provides many wearing positions on the neck and head. The garment can accommodate various uses and various body sizes by virtue of being formed of a stretch material and/or being provided with an adjustable fastener. The adjustable fastener can be of the hook and loop style or can be a button in cooperation with a plurality of button holes, snap connectors, or other connectors, as know in the art, or become known in the art. The garment can also include areas of increased width in the fabric loops to provide optimal coverage of the nose, mouth and chin, and optionally additionally cover the neck while conforming to facial contours. Additionally, the garment can be worn with a narrow section at the forehead and a wide section over the user's ears and nape.

BRIEF DESCRIPTION OF THE DRAWINGS

FIG. 9 is a top view of a double loop embodiment of the present invention.

FIG. 10 is a top view of a triple loop embodiment of the present invention.

FIG. 11 is a perspective view of a FIG. 8 type of loop embodiment of the present invention.

FIG. 12 is a perspective view of a single loop fabric for use in accordance with the present invention.

FIG. 13 is a perspective view of a single loop fabric twisted to form a pair of loops prior to being folded over into a pair of substantially concentric loops.

FIG. 22 is a top view of the garment in the unfastened position and showing the narrow band overlying the enlarge band region.

FIG. 23 is a bottom view of the embodiment of FIG. 22 showing the oval like shape of the enlarged region.

FIG. 24 is a perspective view of the embodiment of FIG. 22.

DETAILED DESCRIPTION OF THE INVENTION

The device of the present invention can be formed of a single length of fabric. The fabric is preferably a stretch fabric or a combination of fabrics including spandex or any stretch, thread as well known in the art. The selection of a fabric would use the same criteria as well known in the art for thermal insulation, comfort and aesthetic qualities.

Advantageously, the fabric is formed of a high warmth fiber such as wool or a synthetic thermal fiber.

The article in one preferred embodiment can be formed from a single length of fabric about the length of a standard scarf or somewhat shorter. The width can be on the order of the width of a headband and advantageously includes an enlarged region. The length of the article must be sufficient to form a loop to encircle the forehead and a loop to encircle the chin and/or nose region and/or neck. The ends can employ a fastener such as a hook and loop connector, buttons, snaps or other convenient mechanism, know in the art now or in the future. String ties can also be employed.

Forming the article of clothing with a widened center section provides flexibility as to use. The widened section can be folded over to provide for a uniform width article or can be used unfolded, to better adapt to the size and shape of the chin and nose areas of a person's face. While each loop can have a widened section, advantageously, the forehead-encircling loop is of substantially uniform width. That does not mean that it must be exactly rectangular in shape, but rather can divert from a rectangle, as desire. Preferably, the forehead-encircling loop is a rectangle or approximates a rectangle.

Figure 1:
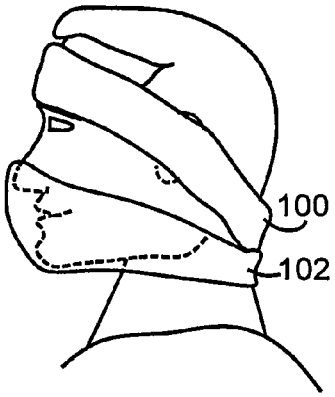
FIG. 1 is a side view of a person wearing the article of clothing of the present invention, as a full face warmer.

As best seen in FIG. 1, the article of clothing having a first loop 100 and a second loop 102, can be used to cover the mouth and nose region and the ears.

Figure 2:
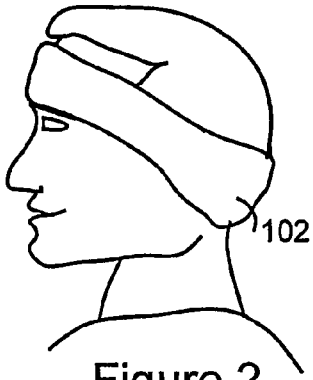
FIG. 2 is a side view of a person wearing the article of clothing of the present invention as a headband ear warmer.

As best seen in FIG. 2, the two loops can be in an overlying relationship and the wide section of loop 102 can be used to cover the ears of the wearer. In the application, the releasable connector is positioned at the forehead of the user. By way of contrast, in the applications of FIGS. 1 and 3, the releasable connector is advantageously at the nape of the neck of the user.

Figure 3:
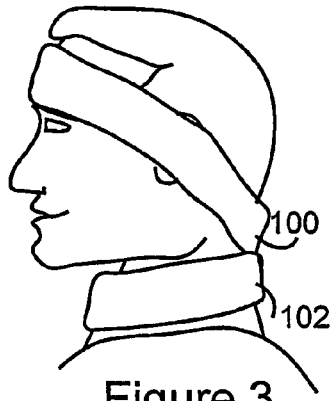
FIG. 3 is a side view of a person wearing the article of clothing of the present invention as a combination headband and neck warmer.
Figure 7:
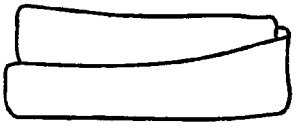
FIGS. 6, 7 and 8 illustrate three different embodiments in which the article of clothing is a circular member, or single loop.
Figure 6:
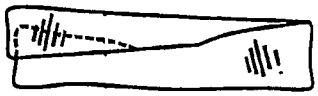
Figure 4:
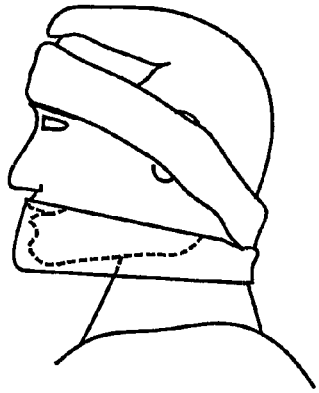
FIG. 4 is a side view of a person wearing the article of clothing of the present invention as a headband and mouth protector.
Figure 8:
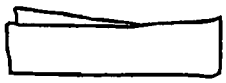

FIG. 3 illustrates the use of the article to protect the neck and ears, with the narrow band 100 at the forehead/ear position and the wide band 102 at the neck. FIG. 4 shows the use of the wide band or loop 102 of the garment over the mouth and the narrow band 100 over the ears, with the nose uncovered.

Figure 5:
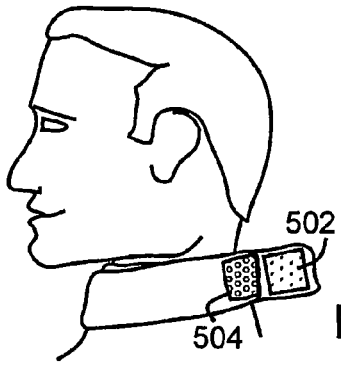
FIG. 5 is a side view of a person wearing the article of clothing of the present invention as a neck warmer or scarf and showing one form of fastener.

The garment of the present invention is a unitary structure formed preferably formed from two garment units secured together, as by sewing or the like. Alternatively, it can be a single, elongated unit as illustrated in FIGS. 9 through 13 for example, or a sewn together embodiment as illustrated in FIG. 22 and FIGS. 1 through 8, for example. In the single unit embodiment, the looping of the article is preferably, and most simply provided with hook 502 and loop 504 cooperating ends as illustrated in FIG. 5. Alternatively, it can be formed of a stretch fabric sewn together to form a continuous loop 900, 100, or 1300, as illustrated in FIGS. 9 through 13, respectively.

As a further embodiment, at least one end of the embodiment of FIG. 5 can be provided with a hook connector or loop connector on both the face or obverse side and the backside. In this manner, the same garment can be used alternatively as illustrated in FIG. 5, 11, 12 or 13.

Figure 14:
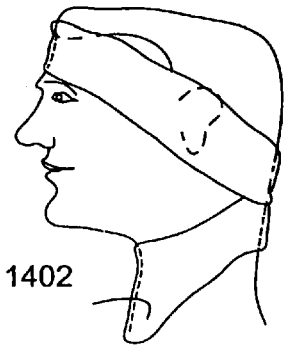
FIGS. 14, 14A and 14B are side views of a person wearing the article of the present invention in various combinations of a combined chin and nose warmer, with an enlarged region providing an increased area of protection to the neck or face.
Figure 14A:
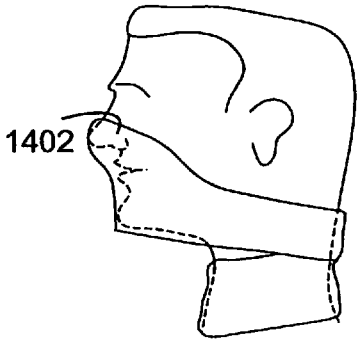
Figure 14B:
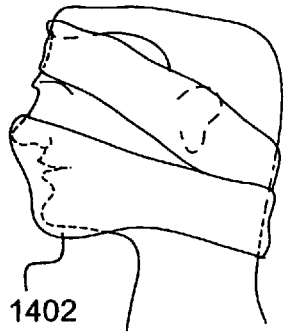
Figure 14C:
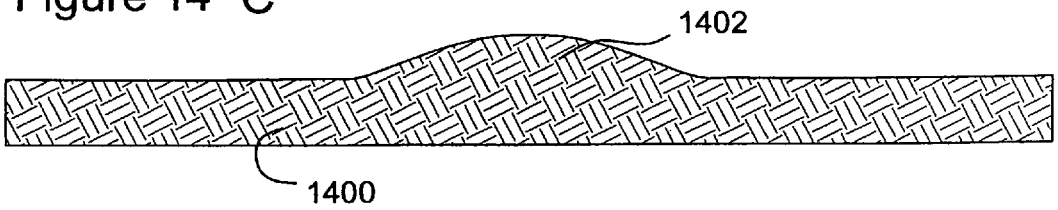
FIGS. 14C and D are plan views of the article of clothing and FIGS. E and F are side views corresponding to views C and D.
Figure 14D:
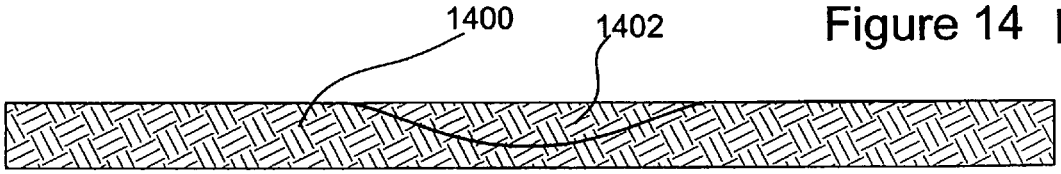
Figure 14E:
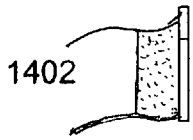
Figure 14F:
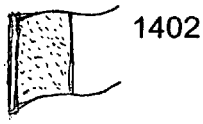

FIG. 14 shows a person wearing the article of the present invention as a combined chin and nose warmer, with an enlarged region 1402 providing an increased area of protection to the neck. As shown in FIG. 14C shows the warmer 1400 in its open form, while FIG. 14D shows the enlarged region folded over. FIGS. 14E and 14F are end views corresponding to FIG. 14D and FIG. 14C, respectively.

The garment 1400 can be used in numerous different combinations, as illustrated in the various Figures. In the embodiment of FIG. 14C the enlarged region 1402 is preferably centrally located and has a curved peripheral edge. The enlarged area can be on one side as shown, or on both sides. The enlarged region can alternatively be a tapered enlarged region as illustrated in FIG. 1. The enlarge region can also be in the form of an enlarged or extended diamond.

The garment can accommodate various uses and various body sizes by virtue of being formed of a stretch material. Alternatively, or additionally, one of the hook and loop connectors can be extended in length so that it can have a range of overlap, thereby producing a range of effective length.

The region or band of the garment that covers the lower face, that is, the nose and or the mouth does not have a direct equivalent in standard garments. Full-face ski masks can cover this region of the face but must cover the entire face.

Figure 15:
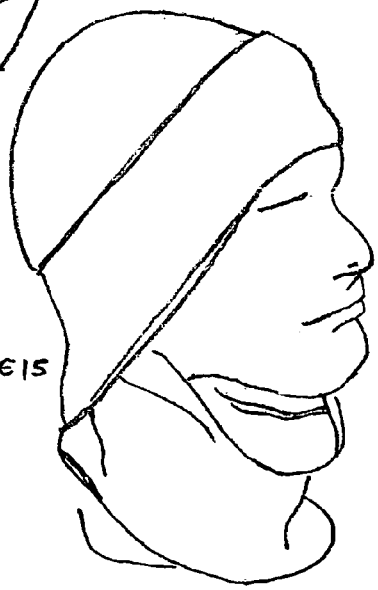
FIG. 15 is a side view of a person wearing the article of the present invention as a combined ear protector and neck warmer and 15A shows an alternate embodiment of the use of the garment.

FIG. 15 is a side view of a person wearing the article of the present invention as a combined ear protector and neck warmer with the enlarge band section around the neck and loosely folded over itself.

Figure 16:
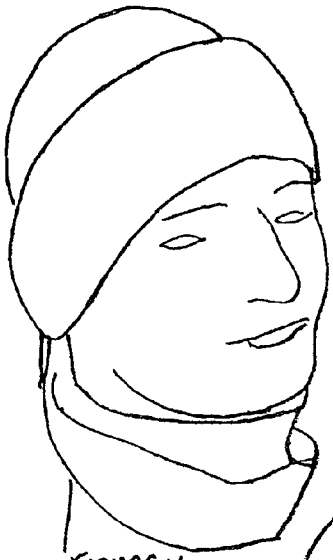
FIG. 16 is a side view of a person wearing the article of the present invention as a combined ear protector and face protector, with an enlarged region rolled over to provide extra protection to the chin.

FIG. 16 shows a person wearing the article of the present invention as a combined ear protector and neck warmer with the neck portion rolled over the band.

Figure 17:
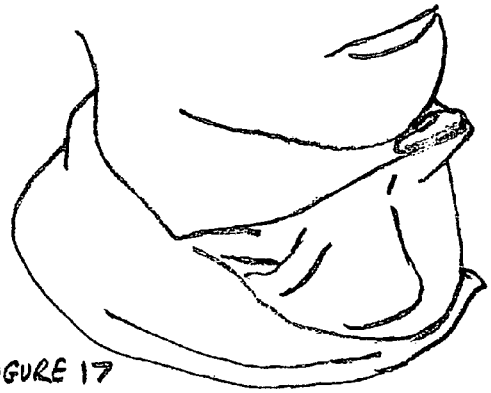
FIG. 17 a plan view of the garment as a scarf with the fabric rolled over to a relatively narrow band.

FIG. 17 shows view of a person wearing the article of the present invention as a neck warmer, with the entire garment loosely gathered around the neck.

Figure 18:
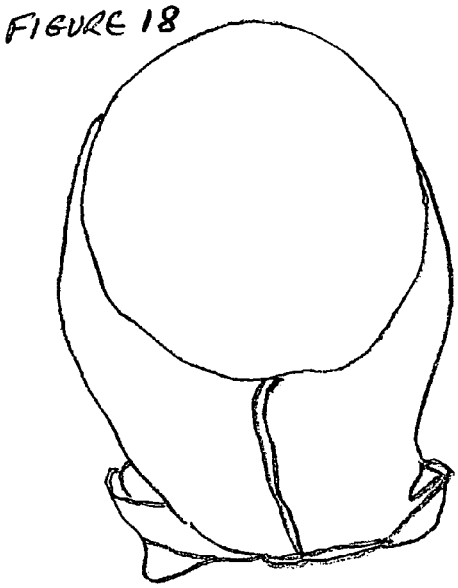
FIG. 18 is an end view corresponding to FIG. 17

FIG. 18 is an illustration of corresponding to an embodiment such as FIG. 15 or 16 and showing the attachment end of the garment centrally positioned at the back of the head.

Figure 19:
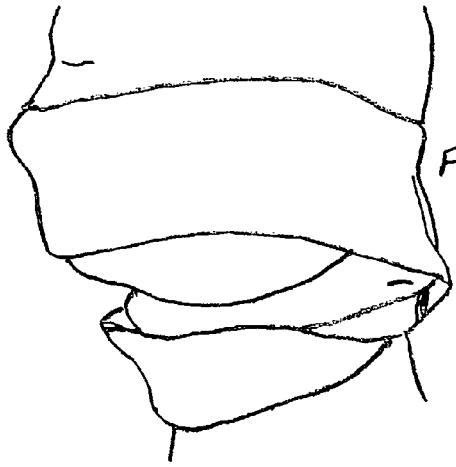
FIG. 19 a plan view of the embodiment of FIG. 17 showing the garment without the fabric is a rear view of a person wearing the garment as a head band and face protector and showing the rear end fastener unit, rolled over to a narrow band.

FIG. 19 shows a person wearing the article of the present invention as a combined nose/mouth and neck protector, with an enlarged region rolled over to provide extra protection to the neck.

Figure 21:
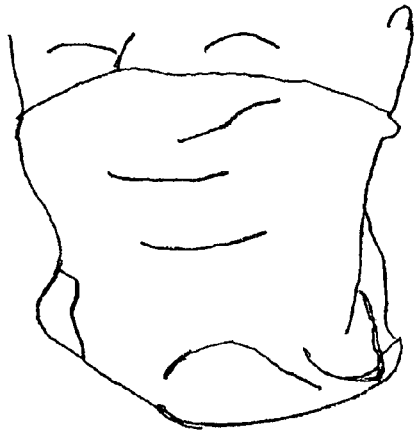
FIG. 21 is a front view of a person wearing the garment with the enlarged region protecting the wear's nose, mouth and chin and the narrow band serving as a scarf.
Figure 20:
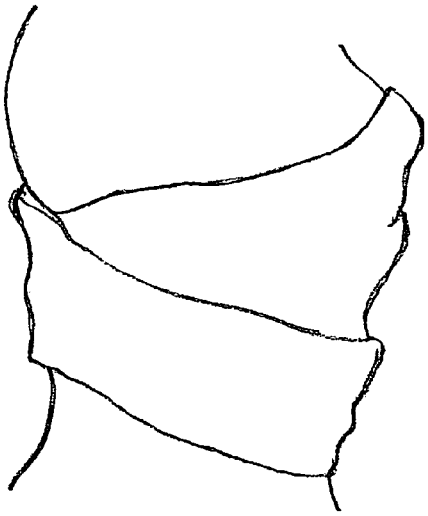
FIG. 20 is a side view of a person wearing the garment with the enlarged region protecting the wear's nose, mouth and chin and the narrow band serving as a scarf.

In the embodiment of FIGS. 20 and 21, the narrow band section is positioned to protect the neck and the enlarge band section protects the nose/mouth/chin and neck regions of the face. The garment is seen to conform to the curvature of the face.

The garment can of FIGS. 17 through 21, be formed from two sections 2202 and 2200, sewn together at their ends. The section 2202 is an elongated rectangular unit while section 2200 is a diamond shaped section. The wide region of the wide band 2200 can be wide in the diamond like configuration or as illustrated in FIG. 14C, can have a single widened region. The term "diamond" should not be construed as implying a configuration having sharp corners, but rather, a sinusoidal or elliptical shape can be used, as illustrated in FIG. 14C.

The garment has a hook and loop connector at each, that is, a loop section at one end, and a hook section 2204 at the other end.

As shown in FIG. 24, the rectangular section 2202 is longer than the section having an enlarged central region.

Figure 25:
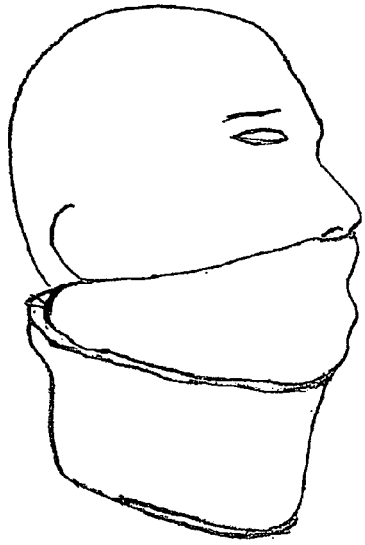
FIG. 25 is a side view of the garment with the enlarged region extending from the neck to the nose, but not covering the nose.

FIG. 25 shows a person wearing the garment with one band protecting the mouth and chin and the other band protecting the neck, but unlike the embodiment of FIG. 20, the nose is uncovered.

Figures 26, 27, 28, 29, 30, 31:
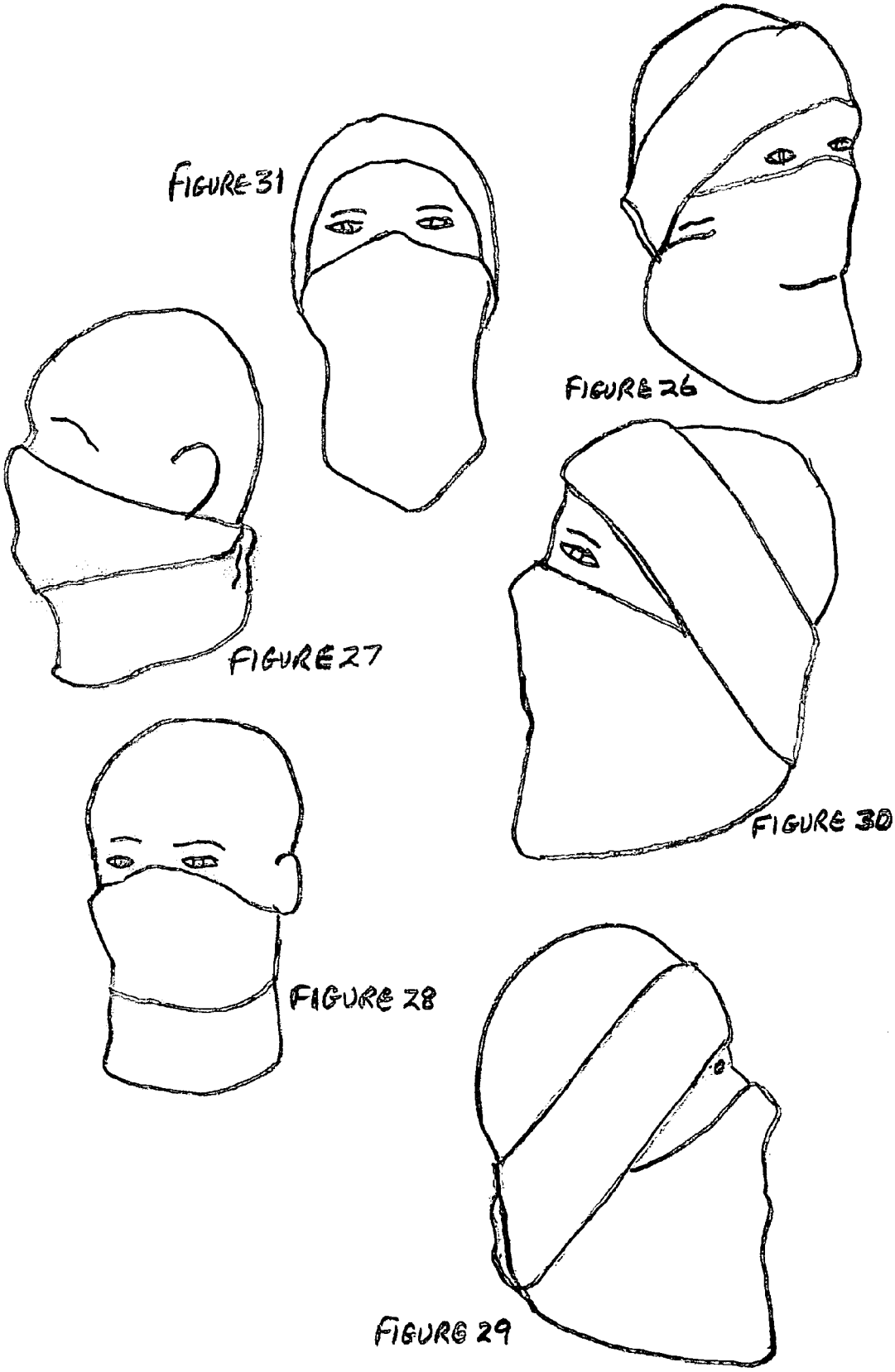
FIG. 26 is a partial front view of an embodiment with the narrow band covering the forehead and ears and the enlarged region extending from the neck to over the nose.
FIG. 27 is a side view of an embodiment showing the garment with the enlarged region protecting the wear's nose, mouth and chin and the narrow band serving as a scarf.
FIG. 28 is a partial front view of an embodiment showing the garment with the enlarged region protecting the wear's nose, mouth and chin and the narrow band serving as a scarf.
FIG. 29 is a view of the right side of an embodiment with the narrow band covering the forehead and ears and the enlarged region extending from the neck to over the nose.
FIG. 30 is a view of the left side of an embodiment with the narrow band covering the forehead and ears and the enlarged region extending from the neck to over the nose.
FIG. 31 is a front view of an embodiment with the narrow band covering the forehead and ears and the enlarged region extending from the neck to over the nose.

FIGS. 26 and 29 show the garment with the narrow band over the forehead and the wide band covering the nose, mouth and neck whereas FIGS. 27 and 28 show the narrow band section covering the neck. The hook and loop connector ends are evident in FIG. 29, but are not evident in the reverse side view of FIG. 16.

FIG. 31 shows a full front view of the side view embodiments of FIGS. 29 and 30.

It is thus seen that the garment of the present invention can be used in a wide variety of different styles. The use of an enlarged region adds further variables to the different combinations in which the article can be employed.

It should be understood that the clothing garment can be a unitary garment formed of two fabric units, a first of said two fabric units being an elongated member and a second of said two fabric units being an elongated, non-rectangular member. The first fabric unit has a first end and a second end, and the second fabric unit having a third end and a fourth end.

The first fabric unit first end and the second fabric unit third end are secured together to form an integrated fifth end, and the first fabric unit second end and the second fabric unit fourth end are secured together to form an integrated sixth end. The method of securing the ends together is not narrowly critical, and can include sewing, adhesion, fusion, or the like.

The integrated fifth end has a first securing member, and the integrated sixth end has a second securing member, such that the first securing member and second securing member are cooperating releasably interlocking members, such as hook and loop fasteners, button, clips, strings, snaps, or the like. In a preferred embodiment, the first fabric unit is a substantially rectangular member. As previously noted, the term substantially rectangular is now to be narrow construed, but should be understood to include moderate convex or concave shapes, the combination of a straight line and a moderately curved line, as well as parallel edges.

In a preferred embodiment, the second fabric unit has a central region that is wider than its third end and its fourth end. Similarly, the second fabric unit has a central region that is wider than each of the integrated fifth end and the integrated sixth end. Preferably, the second fabric unit has a central region that is wider than the integrated fifth end and the integrated sixth end.

To provide optimal fit of the clothing garment on the user, the first fabric unit is substantially longer than said second fabric unit, preferably, by several inches, but the length difference can be in the range from about two inches to seven inches, and most preferably in the range from about three to six inches. In metric units, the range can be from about five centimeters to about eighteen centimeters.

In order for the garment to adequately cover the wearer's ears and forehead, and for optimizing the aesthetics of the garment, the first fabric unit (such as band 1400 of FIG. 14D, or band 2202) of FIG. 22, is substantially uniform in width. For the garment to adequately cover the wear's nose, mouth and chin simultaneously, the second fabric unit (as illustrated for example, in FIG. 14C and part 1402 or part 2200 of FIG. 22, and parts 2200 of FIG. 22, and 2302 FIGS. 23 and 24) has a central region that is wider than the widest region of the first fabric unit. The wide region extends between the apices 2310 and 2312 of FIGS. 23 and 24, for example. Preferably, the wide region has a width in the range from about four to ten inches. It should be understood, that in the embodiment of FIG. 14C, a width would be less than the preferred width of the embodiment of FIG. 23. In metric terms, the range is from about ten centimeters to about twenty five centimeters. The first fabric unit 1400 or 2300, can have a width in the range from about two to about four inches and preferably, the second fabric unit is at least two inches wider at its widest region than the widest region of the first fabric unit. The length of the band 2300 between ends 2414A and 2414B of FIG. 24, is preferably in the range from about 20 to 23 inch and most preferably in the range from about 21 to 22 inches for adults. A child's version would be relatively smaller.

In the embodiment in which the clothing garment is unitary garment formed of a single fabric member, the garment is looped to form a first loop that corresponds to the above described first fabric unit and a second loop that corresponds to the above described second fabric unit.

The method applying the garment to the wearer, includes the steps of stretching and looping the garment in two encircling loops around the head of a user. A first loop encircles the user's head inclusive of said user's forehead and ears and a second loop encircles the user's head and overlying at least one of said user's nose, mouth and chin and said user's nape. As previously noted, the second fabric unit has a width dimensioned to overlie said user's nose, mouth and chin. In another implementation, the first loop encircles the user's head inclusive of the user's forehead and ears and a second loop encircles the user's neck.

In a further implementation, the first loop encircles the user's neck the second loop encircles and overlies at least one of said user's nose, mouth and chin. It should be understood that the reference to encircling the user's head, refers to the loop covering the nape of the neck and a front, facial region, such as the forehead, nose, chin, and/or mouth.

In a still further implementation, both the first loop and the second loop encircles the user's neck or overlie at least one of said user's nose, mouth and chin. It should be understood that in this implementation, the first loop is substantially concentric with the second loop.

In a still another implementation, both the first loop and the second loop encircles the user's overlie the wear's forehead and ears, such that the widest section of the second loop covers the user's ears, and advantageously, the user's nape. It should be understood that in this implementation, the first loop is substantially concentric with the second loop and the second loop has a narrow section that overlies the user's forehead. In this embodiment, the narrow section of the second section is preferably about equal in width to the width of the first loop. It should also be noted that in this embodiment, the hook and loop attachment mechanism, or other interlocking mechanism, lies at the forehead of the user and resembles, conventional ear warmers that employ a narrow forehead region and a wider, ear covering region. This should be understood to be a reversal of the previously described implementations in which the interlocking mechanism is positioned at the nape of the neck.

By way of overview, it is noted that the clothing garment is formed in two loops or bands as a unitary garment. A first of the two loops is an elongated member and the second is an elongated, non-rectangular member, having a wide central region. The two loops can be in the form of two pieces of fabric sewn or otherwise bonded together to form two, joined loops. The loops can be elongated pieces of fabric formed into loops by a releasable closure member, such as a hook and loop connector. The connector can provide size adjustment to accommodate various head sizes. The loop with the wide central region is shorter than the essentially rectangular loop.

It should be understood that the foregoing methods are applicable to the single piece as well as to the two piece design and that the garment's unique shape provides many wearing positions on the neck and head and can accommodate various uses and various body sizes by virtue of being formed of a stretchmaterial and/or an adjustable or variable position fastener. The garment can also include areas of increased width in the fabric loops to provide optimal coverage of the head and neck by conforming to facial contours.

It will be obvious to those having skill in the art that many changes may be made to the details of the above described preferred embodiment of the present invention without departing from the underlying principles thereof. Thus, the scope of the present invention should be determined only by the following claims.

What is claimed is:

1. A clothing garment comprising a unitary garment formed of two fabric units, a first of said two fabric units being an elongated member and a second of said two fabric units being an elongated, non-rectangular member, said first fabric unit having a first end and a second end, said second fabric unit having a third end and a fourth end, said first fabric unit first end and said second fabric unit third end being secured together to form an integrated fifth end, and said first fabric unit second end and said second fabric unit fourth end being secured together to form an integrated sixth end, said integrated fifth end having a first securing member, and said integrated sixth end having a second securing member, said first securing member and said securing member being cooperating releasably interlocking members.

2. The clothing garment of claim 1, wherein said first fabric unit is a substantially rectangular member.

3. The clothing garment of claim 2, wherein said second fabric unit has a central region that is wider than said integrated fifth end and said integrated sixth end.

4. The clothing garment of claim 1, wherein said second fabric unit has a central region that is wider than its third end and its fourth end.

5. The clothing garment of claim 4, wherein said second fabric unit has a central region that is wider than said integrated fifth end and said integrated sixth end.

6. The clothing garment of claim 5, wherein said first fabric unit is substantially uniform in width, and said second fabric unit has a central region that is wider than the widest region of said first fabric unit.

7. The clothing garment of claim 6, wherein said first fabric unit is substantially longer than said second fabric unit.

8. The clothing garment of claim 6, wherein at least one of said first fabric unit and said second fabric unit is formed of a stretchable fabric, said first fabric unit is dimensioned to encircle the head of a user, inclusive of said user's forehead and ears.

9. The clothing garment of claim 8, wherein said second fabric unit is dimensioned to encircle said user's neck and is stretchable to encircle said user's head and overlie at least one of said user's nose, mouth and chin, when said first securing member and said second securing member are releasably interlocked and positioned at said user's nape, said second fabric unit having a central region that is wider than said integrated fifth end and said integrated sixth end and is dimensioned to overlie said user's nose, mouth and chin.

10. The clothing garment of claim 9, wherein one of said first securing member and said second securing member is a hook element and the other of said first securing member and said second securing member is a loop member.

11. The clothing garment of claim 1, wherein said first fabric unit is substantially longer than said second fabric unit.

12. The clothing garment of claim 1, wherein at least one of said first fabric unit and said second fabric unit is formed of a stretchable fabric.

13. The clothing garment of claim 1, wherein one of said first securing member and said second securing member is a hook element and the other of said first securing member and said second securing member is a loop member.

14. The method of protecting a user's face under adverse weather conditions, by wrapping the face in a garment, said garment having at least one section, said at least one section having being an elongated unit with an enlarged region, comprising wrapping said garment around said user's face, wherein said garment is formed of a stretchable fabric, and comprising the steps of stretching and looping said garment in two encircling loops around the head of a user, a first loop encircling said user's head inclusive of said user's forehead and ears and a second loop encircling said user's head and overlying at least one of said user's nose, mouth and chin and said user's nape, said second fabric unit having a width dimensioned to overlie said user's nose, mouth and chin, said garment being formed of two fabric units, a first of said two fabric units being an elongated member and a second of said two fabric units being an elongated, non-rectangular member, said first fabric unit having a first end and a second end, said second fabric unit having a third end and a fourth end, said first fabric unit first end and said second fabric unit third end being secured together to form an integrated fifth end, and said first fabric unit second end and said second fabric unit fourth end being secured together to form an integrated sixth end, said integrated fifth end having a first securing member, and said integrated sixth end having a second securing member, said first securing member and said second securing member being cooperating, releasably interlocking members, and further comprising the step of positioning said first securing member and said second securing member at the nape of the user's neck and interlocking said first securing member and said second securing member.

* * * * *